US006536980B2

(12) United States Patent
To

(10) Patent No.: US 6,536,980 B2
(45) **Date of Patent: *Mar. 25, 2003**

(54) RING BINDER HAVING ACTUATING LEVER WITH CUSHION MEMBER

(75) Inventor: Chun Yuen To, New Territories (HK)

(73) Assignee: World Wide Stationery Mfg. Co., Ltd., Kwai Chung (HK)

( * ) Notice: Subject to any disclaimer, the term of this patent is extended or adjusted under 35 U.S.C. 154(b) by 19 days.

This patent is subject to a terminal disclaimer.

(21) Appl. No.: 09/756,855

(22) Filed: Jan. 10, 2001

(65) Prior Publication Data

US 2001/0026726 A1 Oct. 4, 2001

Related U.S. Application Data

(63) Continuation-in-part of application No. 09/539,712, filed on Mar. 31, 2000.

(51) Int. Cl.[7] ..... B42F 13/20

(52) U.S. Cl. ..... 402/26; 128/206.7; 402/4; 402/31; 402/36; 402/38; 402/41; 402/46

(58) Field of Search ..... 402/4, 31, 36, 402/38, 26, 41, 46; 128/206.7

(56) References Cited

U.S. PATENT DOCUMENTS

| | | | | | |
|---|---|---|---|---|---|
| 1,857,287 | A | * | 5/1932 | Schade | 402/2 |
| 5,234,276 | A | | 8/1993 | Semerjian et al. | |
| 5,354,142 | A | | 10/1994 | Yu | |
| 6,280,114 | B1 | * | 8/2001 | To | 402/38 |
| 6,364,558 | B1 | * | 4/2002 | To | 402/38 |

* cited by examiner

*Primary Examiner*—A. L. Wellington
*Assistant Examiner*—Mark T. Henderson
(74) *Attorney, Agent, or Firm*—Birch, Stewart, Kolasch & Birch, LLP

(57) ABSTRACT

A ring binder is disclosed as including a curved upper plate supporting a pair of pivotable hinged leaves to which a number of half-rings are attached, and two pivotable actuating levers for moving the pair of hinged leaves between a first position in which the half-rings are closed and a second position in which the half-rings are open, in which the actuating lever.includes an aperture, and a cushion engaged with each actuating lever, in which the cushion has a first body part and a second body part, in which part of the first body part extends through the aperture of the actuating lever to engage with the second body part.

18 Claims, 7 Drawing Sheets

RING BINDER HAVING ACTUATING LEVER WITH CUSHION MEMBER

This application is a Continuation-In-Part of U.S. patent application Ser. No. 09/539,712 filed on Mar. 31, 2000, the entire contents of which are hereby incorporated by reference.

BACKGROUND OF THE INVENTION

1. Field of the Invention

The present invention relates to a ring binder having an improved actuating lever for opening and closing rings of the ring binder, and more particularly, to an actuating lever having a cushion member for improving tactile characteristics of the actuating lever.

2. Description of the Background Art

Ring binders are known which have a substantially rigid upper plate supporting a pair of hinged leaves pivotally movable relative to each other. A number of half-rings are attached to each of the hinged leaves so that pivoting of the hinged leaves will open or close the half-rings in a snapping motion. This motion is caused by movement of actuating levers located at each longitudinal end of the ring binder.

Conventional actuating levers are typically formed of stamped metal having sufficient rigidity to transmit the forces necessary to open and close the rings. However, the snapping action produces undesirable shock forces which are transmitted to the fingers of the user. Also, because the actuating levers are formed of metal which is typically nickel plated, the actuating levers can become slippery, causing he user's fingers to slip off of the actuating lever, possibly resulting in injury to the user. Additionally, conventional actuating levers have an outwardly turned lip around most of the perimeter to rigidify and reinforce the actuating lever. This edge of the lip can be sharp and uncomfortable to press with the fingers when attempting to close the rings.

One attempt has been made to provide a cover for an actuating lever, as shown in U.S. Pat. No. 5,234,276. The purpose of the cover therein is to make metal actuating levers easier on the fingers of the binder operator and/or to make the actuating levers longer so that more leverage is available. The cover is formed of two hinged plastic pieces that are snapped together to completely encase the actuating lever. Unfortunately, the plastic cover is susceptible to breakage, especially the tiny interlocking studs which hold the two halves together. The hinge can provide sharp edges, especially at the corners, and the seam between the mating halves can collect dirt and dust. Also, the hinge is susceptible to breakage. In addition, the cover is rigid, and rather large and cumbersome, approximately three times the size of the actuating lever, resulting in an unpleasant appearance.

There is thus a need in the art for a ring binder having actuating levers which are comfortable to use and slip resistant, and which minimize the feedback of undesirable forces produced by the snap action of the rings when opening and closing the rings.

It is thus an object of the present invention to provide a ring binder in which the aforesaid shortcomings are mitigated, or at least to provide a useful alternative to the public.

SUMMARY OF THE INVENTION

According to a first aspect of the present invention, there is provided a ring binder comprising an upper structure; a pivotable lower structure supported by said upper structure; a plurality of half-rings attached to said pivotable lower structure and movable therewith; at least one pivotable actuating lever for moving said lower structure between a first position in which said half-rings are closed, and a second position in which said half-rings are open, said actuating lever including an aperture therein; and a cushion engaged with said actuating lever, said cushion having a first body member and a second body member, wherein at least part of said first body member extends through said aperture of said actuating lever to engage with said second body member.

According to a second aspect of the present invention, there is provided, in combination, a ring binder having a pivotable actuating lever with an aperture therein, a cushion engaged with said actuating lever, which cushion including a first body member and a second body member, wherein at least part of said first body member extends through said aperture of said actuating lever to engage with said second body member.

It should of course be understood that the detailed description and specific example, while indicating a preferred embodiment of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENT

Figure 1:
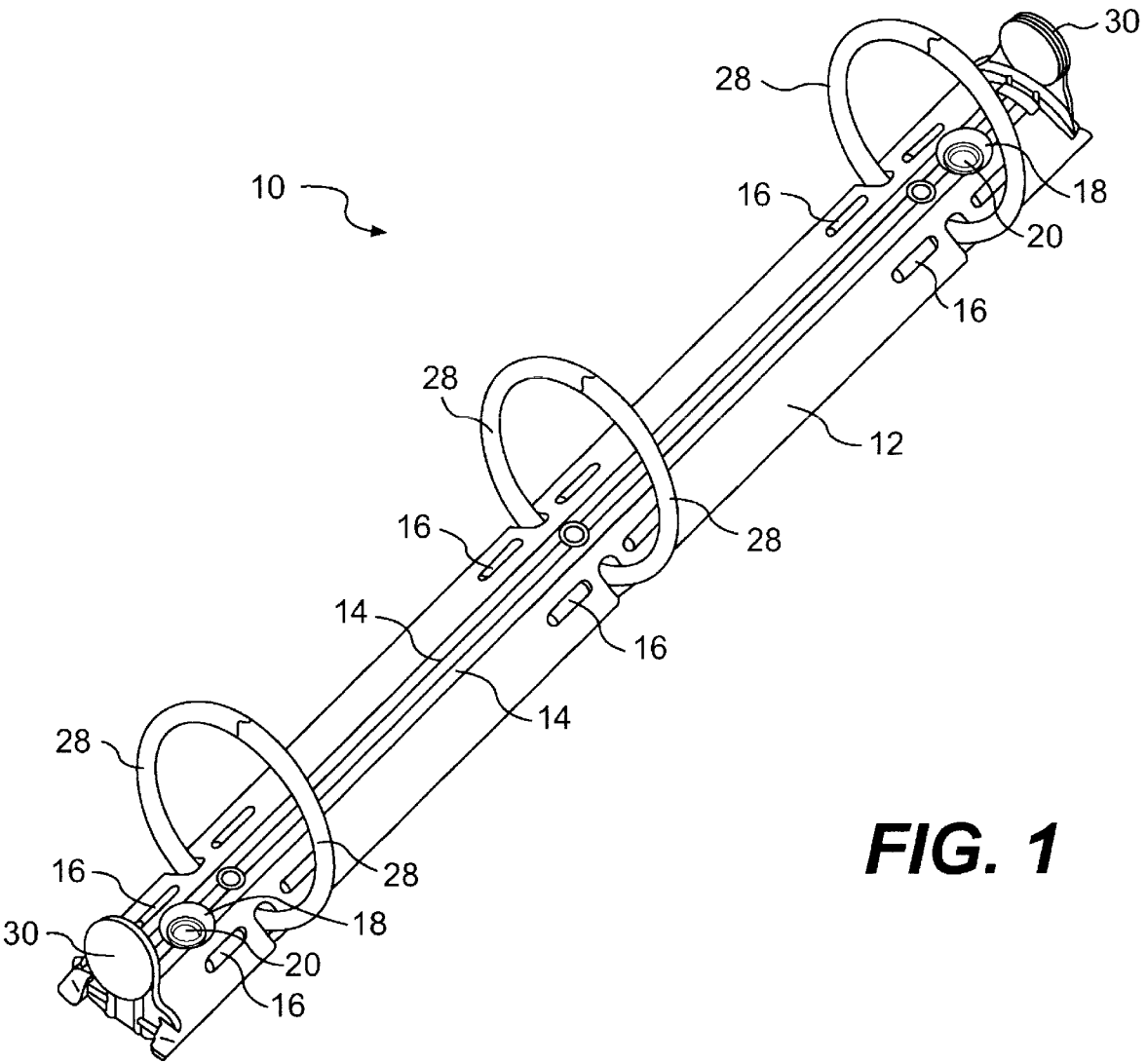
FIG. 1 is a top perspective view showing a ring binder according to the present invention in which the rings are closed.
Figure 2:
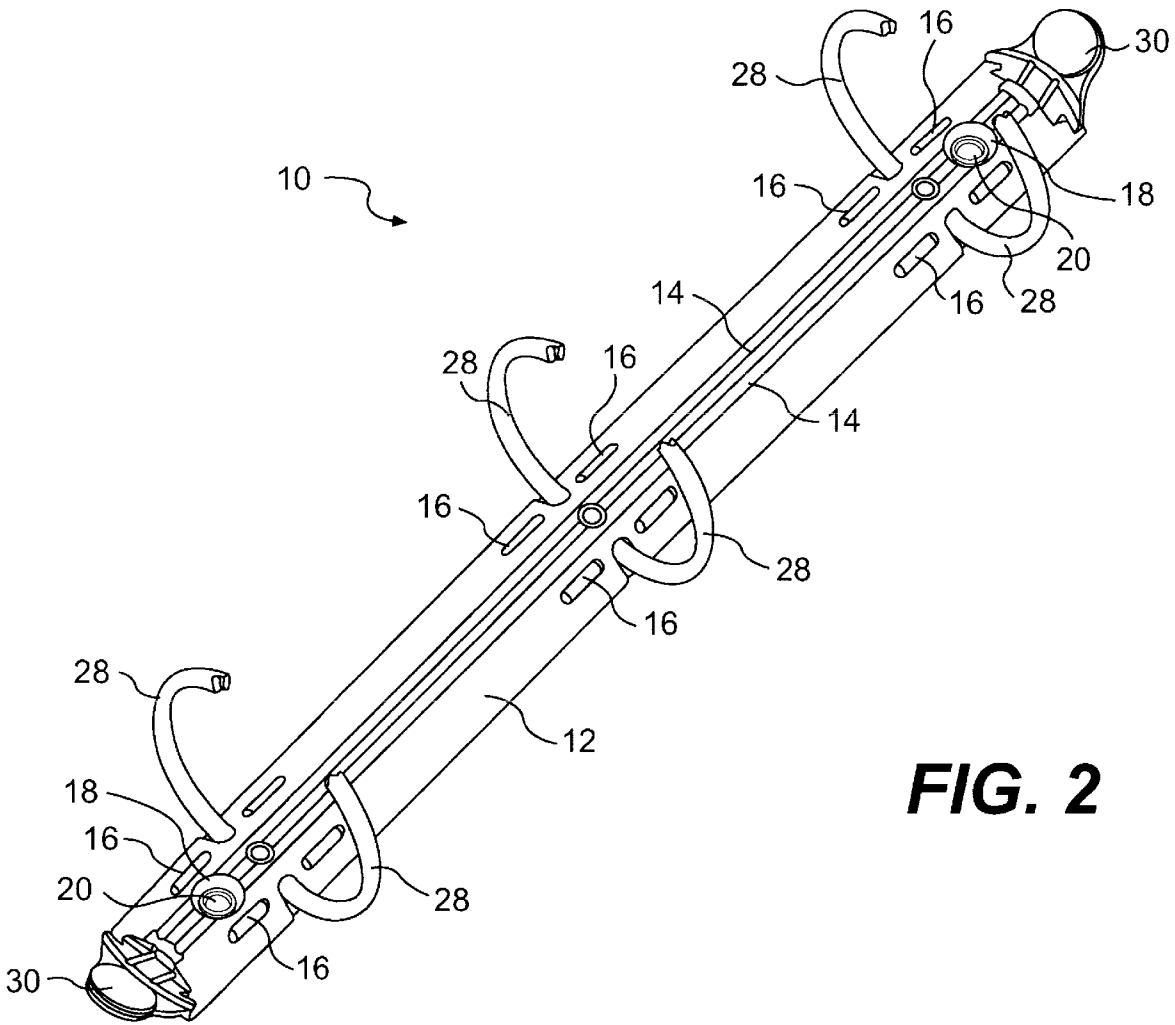
FIG. 2 is a top perspective view of the ring binder shown in FIG. 1 in which the rings are open.
Figure 3:
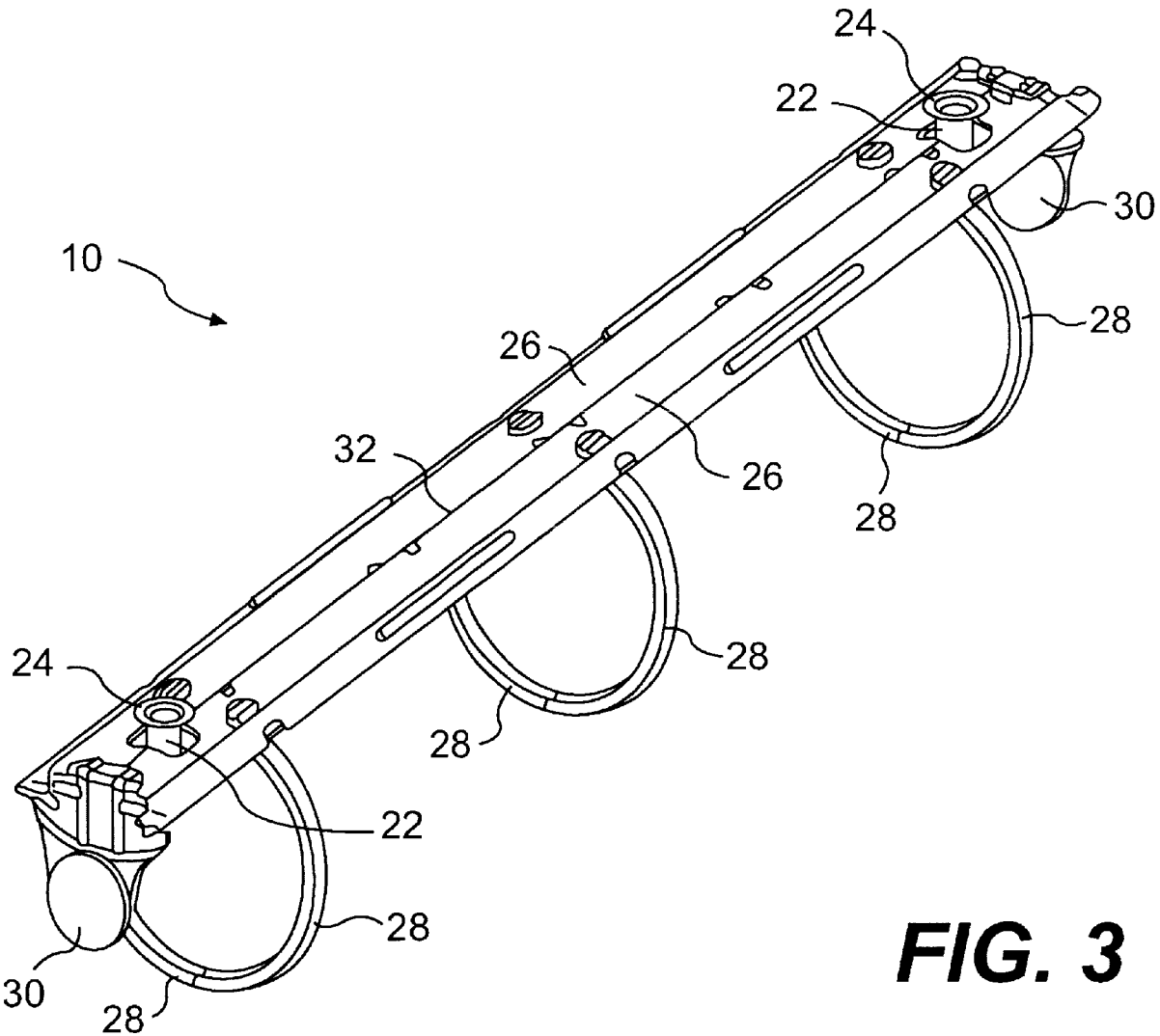
FIG. 3 is a bottom perspective view of the ring binder shown in FIG. 1 in which the rings are closed.
Figure 4:
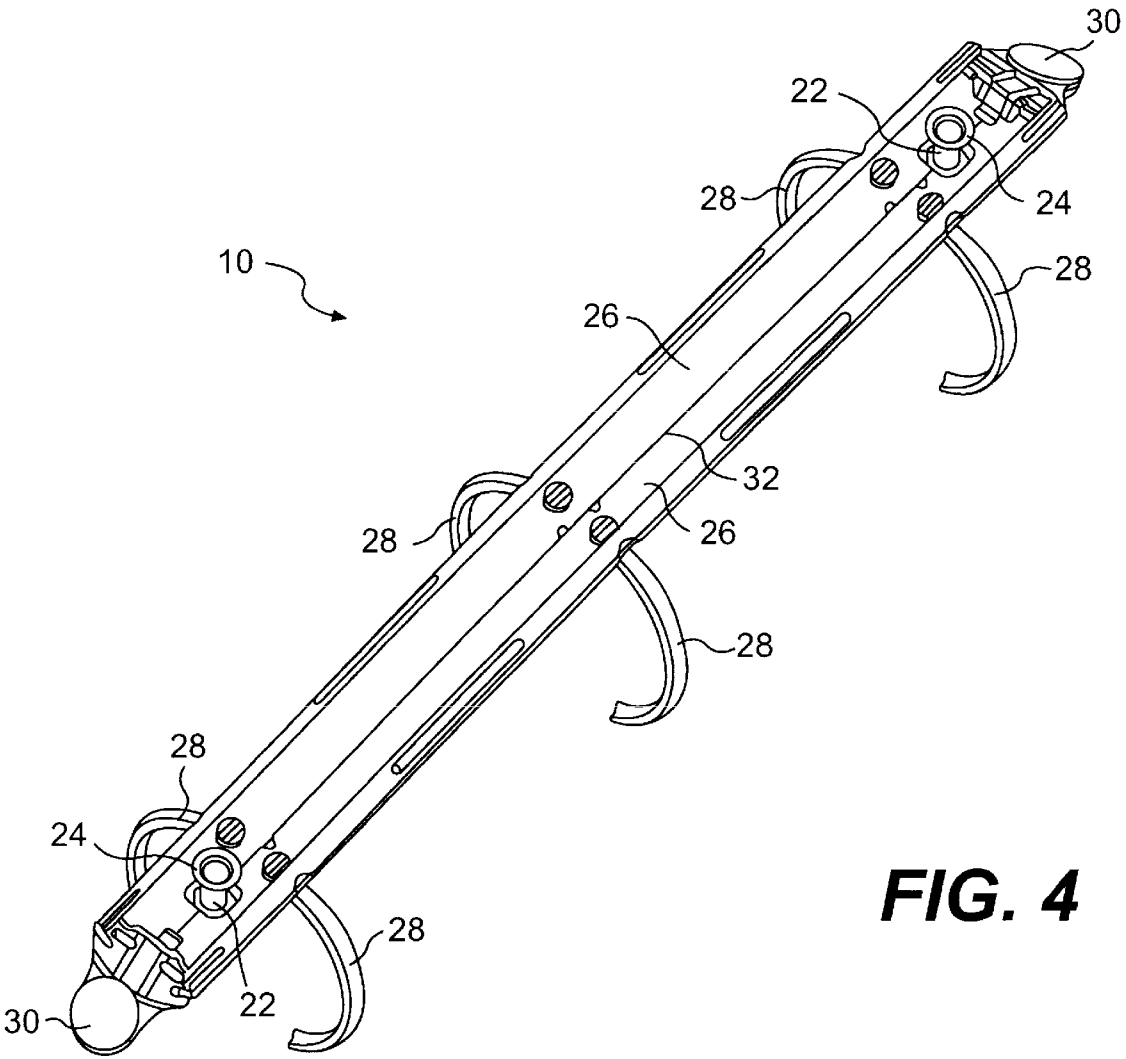
FIG. 4 is a bottom perspective view of the ring binder shown in FIG. 1 in which the rings are open.
Figure 5:
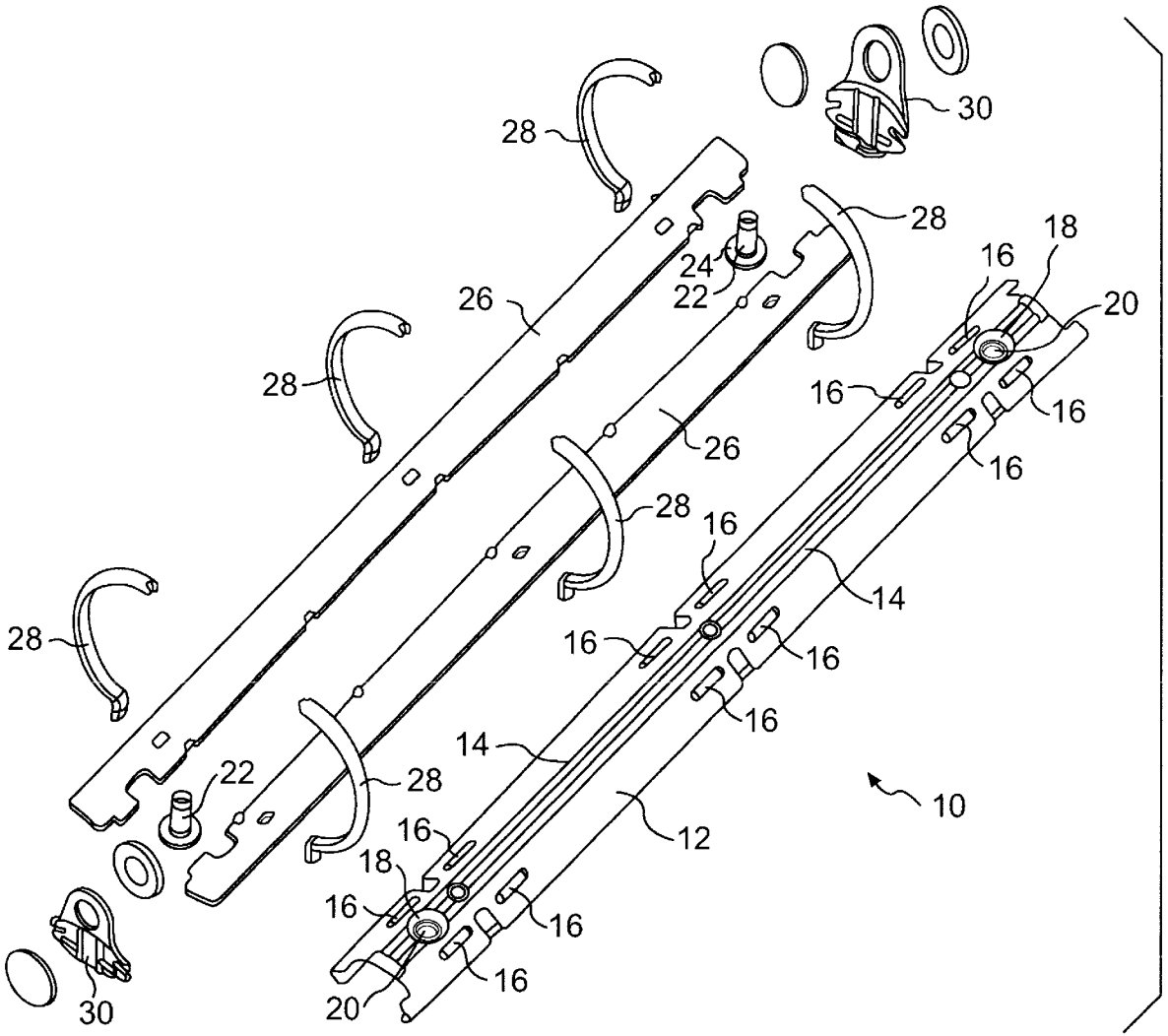
FIG. 5 is an exploded perspective view of the ring binder shown in FIG. 1.

A ring binder according to the present invention is shown in FIGS. 1 to 5, and generally designated as 10. The ring binder 10 is securable to a cover member (not shown) to produce a loose-leaf binder. The cover member preferably includes a spine located between front and back covers of the cover member. The ring binder 10 may be attached to the cover member by any conventional fasteners, such as rivets, which extend through the cover member and which are deformed, e.g. by punching, to securely and permanently fix the ring binder 10 to the cover member.

The ring binder 10 includes a substantially rigid curved upper plate 12. The curved upper plate 12 includes a pair of first reinforcing ribs 14 extending longitudinally along the centre thereof. The first reinforcing ribs 14 protrude upwardly and outwardly from an outer surface of the curved upper plate, thereby increasing the resistance of the curved upper plate 12 to bending. The first ribs 14 extend substantially along the entire length of the curved upper plate 12 from one end to another. The curved upper plate 12 further includes several pairs of second ribs 16, which protrude upwardly and outwardly from the outer surface of the curved upper plate 12, and which are located outwardly of the first ribs 14.

The curved upper plate 12 further includes a depression 18 near each end thereof. Each depression 18 includes an aperture 20 extending through the curved upper plate 12. A cylindrical post 22 is attached to the curved upper plate 12 at the depression 18. One end of the cylindrical post 22 is secured within the aperture 20, e.g. by pressing. The other end of the cylindrical post 22 has a flange 24 which forms a base for the ring binder 10 for attachment to the cover.

A pair of hinged leaves 26 are supported by the curved upper plate 12. The curved upper plate 12 provides a biasing force on the hinged leaves 26 such that the hinged leaves 26 move in an over-centre manner. A plurality of ring members 28 are secured to the hinged leaves 26 for engaging corresponding holes in sheets of material retained by the ring binder 10.

An actuating lever 30 is located at each end of the curved upper plate 12 for actuating the hinged leaves 26 to open and close the ring members 28. When the ring members 28 of the ring binder 10 are in a closed position, movement of the actuating levers 30 away from each other causes a central hinge portion 32 of the hinged leaves 26 to move toward the curved upper plate 12, thereby causing the ring members 28 which move with the hinged leaves 26 to move to an open position. Conversely, when the ring members 28 of the ring binder 10 are in an open position, movement of the actuating levers 30 toward each other causes the central hinge portion 32 of the hinged leaves 26 to move away from the curved upper plate 12, thereby causing the ring members 28 to return to the closed position. A known ring binder including a conventional opening/closing mechanism with an actuating lever is more fully disclosed in U.S. Pat. No. 5,354,142, the entire contents of which are hereby incorporated by reference.

An actuating lever 30 of the present invention is shown in FIGS. 6 to 9. The actuating lever 30 includes a main body 50 made of metal having a nickel plated finish. Each actuating lever includes a plurality of reinforcing ribs 52 thereon to increase the rigidity of the main body 50. The main body 50 further includes a pair of grooves 54 on opposite side edges which form a pivot axis of the actuating lever 30. A lower portion of the main body 50 includes a hook member 56 which engages and moves the hinged leaves 26. An upper portion of the main body 50 is the portion engaged by the fingers of the user to pivot the actuating lever 30 about the pivot axis defined by the grooves 54, in order to open and close the ring members 28 of the ring binder 10. The upper portion of the main body 50 includes a curved perimeter edge 58. An aperture 60 is located in the upper portion of the main body 50.

Two cushion parts 62*a*, 62*b* are also shown. The cushion parts 62*a*, 62*b* are of a soft pad of resilient material, which is preferably made of rubber or soft plastic. As can be seen more clearly in FIG. 9, proceeding from left to right, the cushion part 62*a* has a first portion 64 having a first diameter, a second portion 66 having a second diameter smaller than the first diameter, and a third portion 68 having a third diameter larger than the second diameter. The diameter of the second portion is approximately equal to or slightly smaller than the diameter of the aperture 60 in the actuating lever 30. The diameters of the first portion 64 and the third portion 68 are larger than the diameter of the aperture 60 in the actuating lever 30.

The third portion 68 of the cushion part 62*a* has a chamfered circumferential edge 70. The first portion 64 of the cushion part 62*a* has a slightly outwardly curved face 72. The face 72 of the first portion 64 is engaged by the finger of a user to pivot the actuating lever 30 to move the ring members 28 to the open position.

As to the cushion part 62*b*, such includes an outward substantially flat face 74 and a circular recess 76 with a circular undercut portion 78. When the cushion part 62*b* is installed onto the main body 50 of the actuating lever 30, the fact 74 of the cushion part 26*b* is engaged by the finger of a user to pivot the actuating lever 30 to move the ring binders 28 to the closed position.

Figure 8:
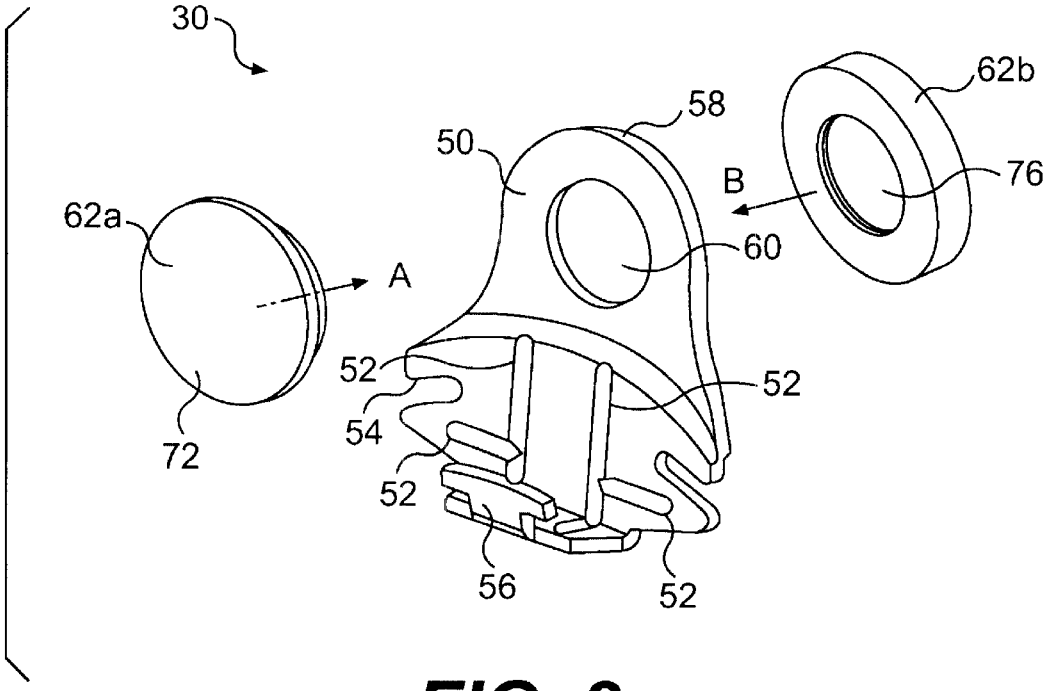
FIG. 8 is a perspective view showing the components forming the actuating lever shown in FIG. 6.
Figure 9:
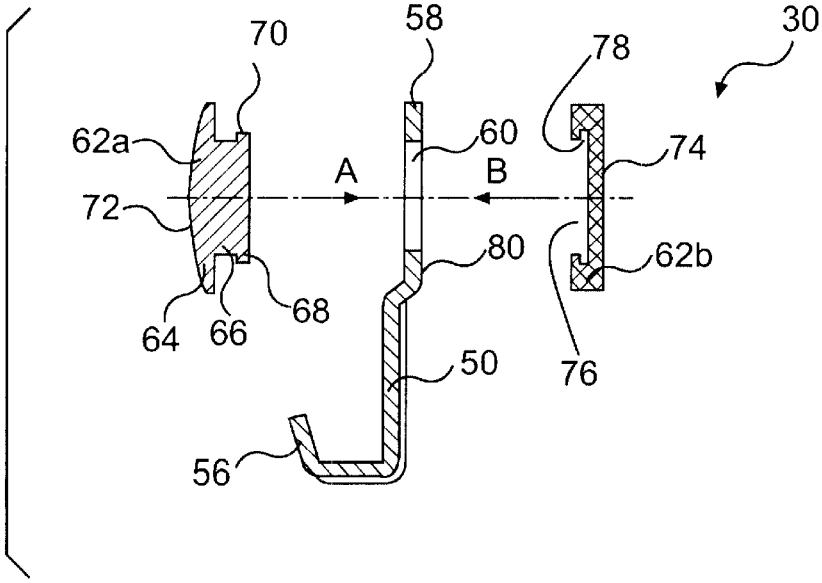
FIG. 9 is a sectional view of the components forming the actuating lever shown in FIG. 8.

To install the cushion parts 62*a*, 62*b* onto the main body 50 of the actuating lever 30, the cushion part 62*a* is pressed against the upper portion of the main body 50 of the actuating lever 30 in the direction indicated by the arrow A in FIGS. 8 and 9. Because of the resilience of the material with which the cushion part 62*a* is made, and the assistance of the chamfered circumferential edge 70 of the third portion 68, the third portion 68 enters into and eventually passes the aperture 60 of the main body 50, and the second portion 66 extends through the aperture 60. In this way, the cushion part 62*a* is engaged with the main body 50 of the actuating lever 30 in a snap fit manner. As the length of the second portion 66 is larger than the thickness of the aperture 60, when the cushion part 62*a* is so engaged with the main body 50, the third portion 68 of the cushion part 62*a* is clear of a back side 80 of the upper portion of the main body 50 of the actuating lever 30.

Figure 6:
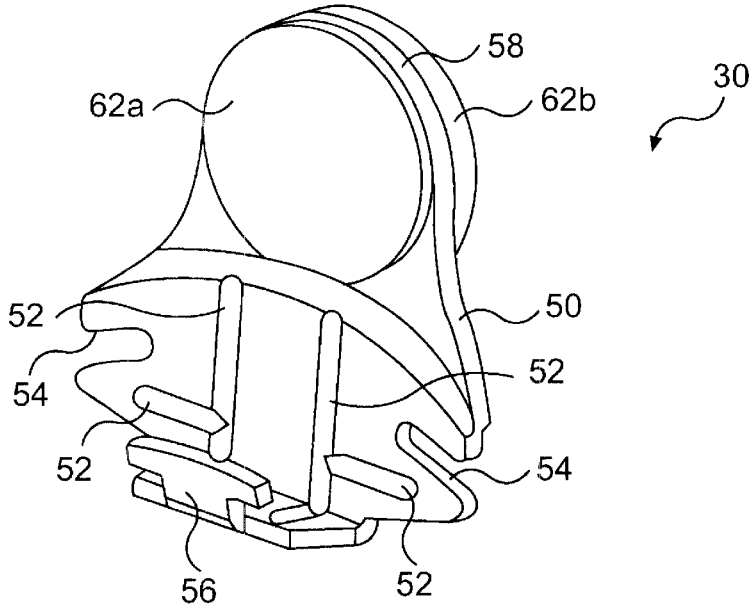
FIG. 6 is an enlarged perspective view of the actuating lever in the ring binder shown in FIG. 1.
Figure 7A:
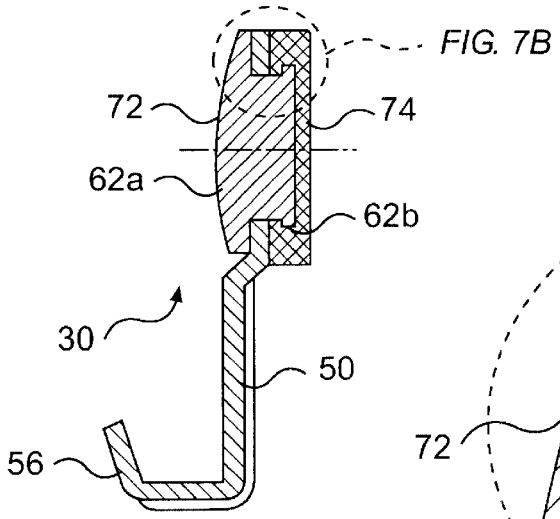
FIG. 7A is a sectional view of the actuating lever shown in FIG. 6.
Figure 7B:
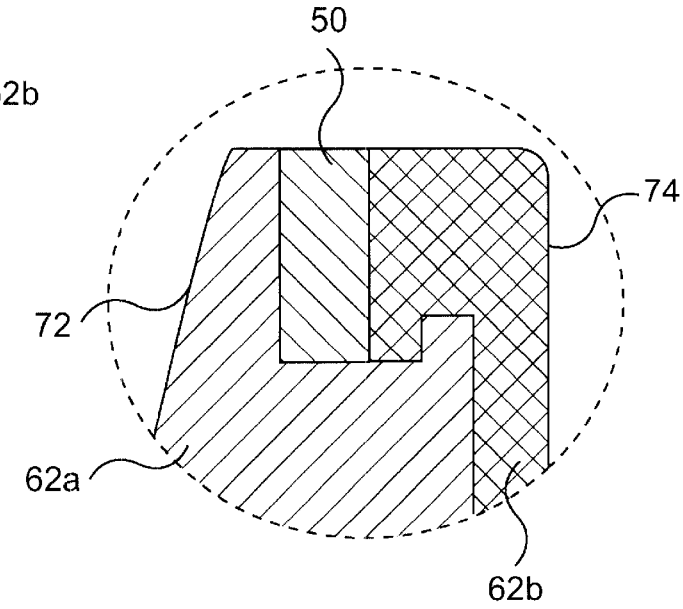
FIG. 7B is an enlarged view of the encircled part of the actuating lever shown in FIG. 7A.

The cushion part 62*b* is then pressed against the third portion 68 of the cushion part 62*a*, in the direction indicated by the arrow B in FIGS. 8 and 9. Because of the resilience of the material with which the cushion parts 62*a*, 62*b* are made, and the assistance of the chamfered circumferential edge 70 of the third portion 68, part of the third portion 68 is received within the undercut portion 78, also in a snap fit manner, so as to engage the cushion parts 62*a*, 62*b* with each other. The main body 50 of the actuating lever 30 is thus sandwiched between the cushion parts 62*a*, 62*b*, as shown in FIGS. 6 to 7B.

It should be understood that the above only illustrates an example whereby the present invention may be carried out, and that various modifications and/or alterations may be made thereto without departing from the spirit of the invention.

It should also be understood that various features of the invention which are, for brevity, described in the context of a single embodiment, may be provided separately or in any appropriate sub-combinations.

What is claimed is:

1. A ring binder comprising:

an upper structure;

a pivotable lower structure supported by said upper structure;

a plurality of half-rings attached to said pivotable lower structure and movable therewith;

at least one pivotable actuating lever for moving said lower structure between a first position in which said half-rings are closed, and a second position in which said half-rings are open, said actuating lever including an aperture therein; and a cushion engaged with said actuating lever, said cushion having a first body member and a second body member, wherein at least part of said first body member extends through said aperture of said actuating lever to engage with said second body member, wherein said second body member includes a recessed portion, and wherein said recessed portion of said second body member receives at least part of said first body member.

2. The ring binder according to claim 1 wherein said first and second body members are formed of rubber or soft plastic.

3. The ring binder according to claim 1 wherein said first and second body members are snap-fitted with each other.

4. The ring binder according to claim 1 wherein said first body member includes a first portion having a first diameter, a second portion with a second diameter smaller than said first diameter, and a third portion with a third diameter larger than said second diameter.

5. The ring binder according to claim 4 wherein a diameter of said aperture of said actuating lever is substantially the same or slightly larger than said second diameter.

6. The ring binder according to claim 4 wherein at least part of said second portion of said first body member is received within said aperture of said actuating lever.

7. The ring binder according to claim 4 wherein a length of said second portion is longer than a thickness of said aperture of said actuating lever.

8. The ring binder according to claim 4 wherein a diameter of said aperture of said actuating lever is smaller than the first diameter and the third diameter.

9. The ring binder according to claim 4 wherein said third portion of said first body member has a chamfered circumferential edge.

10. In combination, a ring binder having a pivotable actuating lever with an aperture therein, a cushion engaged with said actuating lever, which cushion including a first body member and a second body member, wherein at least part of said first body member extends through said aperture of said actuating lever to engage with said second body member, wherein said second body member includes a recessed portion, and wherein said recessed portion of said second body member receives at least part of said first body member.

11. The combination according to claim 10 wherein said first and second body members are formed of rubber or soft plastic.

12. The combination according to claim 10 wherein said first and second body members are snap-fitted with each other.

13. The combination according to claim 10 wherein said first body member includes a first portion having a first diameter, a second portion with a second diameter smaller than said first diameter, and a third portion with a third diameter larger than said second diameter.

14. The combination according to claim 13 wherein a diameter of said aperture of said actuating lever is substantially the same or slightly larger than said second diameter.

15. The combination according to claim 13 wherein at least part of said second portion of said first body member is received within said aperture of said actuating lever.

16. The combination according to claim 13 wherein a length of said second portion is longer than a thickness of said aperture of said actuating lever.

17. The combination according to claim 13 wherein a diameter of said aperture of said actuating lever is smaller than the first diameter and the third diameter.

18. The combination according to claim 13 wherein said third portion of said first body member has a chamfered circumferential edge.

* * * * *